United States Patent [19]

Burkhead et al.

[11] Patent Number: 4,494,245

[45] Date of Patent: Jan. 22, 1985

[54] TECHNIQUES FOR REPELLING PREDATORY ANIMALS BY THE USE OF APOSEMATIC PATTERNS AND COLORATION

[76] Inventors: Noel M. Burkhead, Rte. 3, Box 272, Salem, Va. 24153; Paul J. Weldon, 4513 Hillview Rd., Knoxville, Tenn. 37916

[21] Appl. No.: 419,979

[22] Filed: Sep. 20, 1982

[51] Int. Cl.[3] ..... A41D 13/00; A42B 3/00; A01M 00/00

[52] U.S. Cl. ..... 2/2; 2/2.1 R; 2/4; 43/1; 405/186; 428/919; 441/86

[58] Field of Search ..... 2/4, 2.1 R, 2, 1, 94; 428/919, 195; 441/80, 86, 102, 103, 136; 405/186; 43/1

[56] References Cited

U.S. PATENT DOCUMENTS 1,139,642 5/1915 Cox ..... 2/1

4,285,068 8/1981 Ross ..... 428/919 X

*Primary Examiner*—H. Hampton Hunter

*Attorney, Agent, or Firm*—James C. Kesterson

[57] ABSTRACT

A method for repelling predatory animals by the use of aposematic patterns and colorations is disclosed. A man (10) if isolated, alone, or injured in marine or ocean waters (24) is substantially at the mercy of numerous predatory organisms that live and thrive in the marine environment (24) such as for example a shark (26). There are however organisms or animals such as deadly *Pelamis platurus* sea snakes (28) which possess oposematic colorations such as bright yellow backgrounds (30) with black irregular spots (32). It has been found that sharks (26) typically have an innate avoidance response to these sea snakes. According to the method of this invention, therefore, the man or diver (10) protects himself from the predatory animal (26) by wearing a wetsuit (12) which mimics the sea snake (28) or some other aposematically colored organism. Thus, according to one embodiment the wetsuit (12) will be made of a bright yellow color background (34) having a multiplicity of black irregular spots (36), (38), and (40). In addition, bathing suits (50) and life preserver (52) may also be manufactured to mimic the coloration of other naturally distasteful or venomous animals. Also, hypothetical patterns which include the three basic aposematic colors red, black, and yellow may be applied to other diving and aqua marine equipment such as life raft (68) diving tank (76), foot flippers (70) and (72) and the like.

11 Claims, 6 Drawing Figures

TECHNIQUES FOR REPELLING PREDATORY ANIMALS BY THE USE OF APOSEMATIC PATTERNS AND COLORATION

DESCRIPTION

1. Technical Field

This invention relates generally to methods of repelling predatory animals by the use of aposematic coloration and patterns, and more particularly to methods for protecting men as they engage in marine and water activities from the predatory habits of sharks. The method is suitable for use to protect swimmers, bathers, scuba divers, sailors or other persons found to be isolated in shark infested waters. It is also suitable for protecting the catch and equipment of fishermen from the predatory attacks of sharks by the use of aposematic coloration and patterns on fishing equipment.

2. Background Art

As man continues to explore his environment, he often finds himself in confrontation with large and/or dangerous predatory animals, or animals which see man as nothing more than a possible meal or a territorial threat. Since man is himself basically a land animal, he is normally more than able to defend himself against other predatory land animals. It is only when he is isolated, injured, and/or unarmed does he began to be at any disadvantage such that land based predatory animals present any real and unmanagable danger. However, as man pushes the frontiers of his activities into hostile environments wherein he must have support equipment for survival except for momentary visits, where his size is not particularly intimidating, and where his mobility is relatively limited with respect to other animals in the environment, he often finds himself much more vulnerable and consequently more likely to be the next meal or the target of an attack of a predatory animal which is at home in the hostile environment. The ocean is, of course, a prime example of an environment in which man is at a drastic disadvantage in comparison to the native or aquatic organisms. Further, if man also finds himself injured, isolated, and unarmed in an unfamiliar or hostile environment such as the ocean, he is meagerly equipped to defend himself against the oceans natural predators such as sharks, barracudas, etc. Therefore, Navy personnel, fishermen, other sailors, and to some extent persons engaged in water sports at a beach often find themselves in unexpected confrontations with potential marine predators.

Consequently, it is an object of the present invention to provide a method of repelling predatory animals from a target organism or potential prey, such as man, and it is a specific object of this invention to provide a method of repelling predatory ocean animals from an individual in an ocean environment.

Over the years, there have been various ways man has dealt with certain types of particular predatory animals. Techniques for repelling sharks have ranged from the pathetic to the simply ineffective. Even today, certain Japanese fishermen rely on long red sashes to protect them from sharks, and Ceylonese pearl divers place confidence in shark charmers in the same manner as was recorded by Marco Polo in 1298.

The advent of World War II however made it very clear that something more than red sashes and shark charmers was necessary if men were to survive in water without the benefit of lifeboats or life rafts. Thus, in 1944 the U.S. Navy came out with a book entitled "Shark Sense" which presumably provided informatic on how to deal with sharks. Unfortunately, this book c publication contained much inaccurate information an misleading directives. At that time, a great number c experimental chemical repellants were tried with litt or no success. The chemical repellant, copper acetat did seem to repell certain kinds of dogfish shark and ha limited success with some of the larger shark specie Also, "Shark Chaser" was issued by the Navy in 194 which consisted of a water soluable six and one-ha ounce cake of 80 percent black nigrosine dye to conce the floundering seaman. "Shark Chaser" also include 20 percent of copper acetate to repel the sharks. Th cake would last from two to four hours. Of course afte the two to four hour period elapsed the flounderin seamen were again at the mercy of the animals in th sea. In 1958, the Navy had decided that Shark Chase was not a completely acceptable repellant and so at th time it sponsored a shark symposium to explore basi research approaches dedicated to the refining of repe lants. The result of all this testing, indicated that Shar Chaser did have some merit repelling some shark spe cies but was absolutely ineffective with other shark such as the nurse shark. Research continued, howeve and in 1961 *The Australian Journal of Science* reporte certain of the tested substances such as powerful po sons, including potassium cyanide and certain forms c curare were surprisingly ineffective, and no irritan poisons tested gave a rapid result. Magnesium sulfat with chlorhydrate, which according to the report in cluded doses large enough to bring down several larg horses, had no detectable effect on the small shark other than to increase their swimming speed. Finally the researchers discovered that within 30 seconds afte an injection of strychnine nitrate the coordinated move ments of one large shark ceased, within two minutes th shark could be handled, within eight minutes it diec This discovery led to a suggestion that perhaps a sy ringe should be developed which a diver could shoot a a shark and which would inject a shark on contact. Th only problem with this idea is that a shark which i attacking can inflict fatal injuries or do considerabl damage in 30 seconds.

Physical techniques for discouraging sharks have als been tried and include fixed barriers. Such fixed barr ers, of course, have the constant problem of having t be maintained, and, even so, will still eventually suc cumb to the wear and tear of the sea, and thus ar costly. Air bubble curtains have been found to restrai some sharks but are completely ignored by other shark Perhaps the most effective beach barrier to date i called "meshing" which originated in Australia in 193 and was then used in South Africa in 1952. For a furthe discussion of meshing the reader is referred to Chapte 13 "Sharks and The Discouragement Thereof" in book by Thomas H. Lineaweaver, III and Richard H Backus published in 1969, at page 256 under the title o *The Natural History of Sharks* by the J. B. Lippencot Company, New York. Another article on meshing ca be found in Chapter 18 entitled "Anti-Shark Measures by Stuart Springer and Terry W. Gilbert entitled *Shark and Survival* published in 1965 by the D. C. Heath an Company at page 465. The Springer and Gilbert boo also provides a discussion of the various ground rules t be considered in killing or repelling sharks. In particu lar, if the device is to be protective and worthwhile i must be (1) light in weight and easily carried, (2) th device must be operable under water and function either all of the time or when activated and in water, (3) it must also be safe for the user to carry under any and all conditions including adverse conditions, and (4) it should be reasonably effective in driving a shark away or in thwarting an attack. There is also another criteria, which, although, not essential would be highly desirable. This criteria is that the method or device is more useful when the user or target organisms, need not be aware of the immediate presence of a shark. That is, the repelling nature of the device is constantly effective, and requires little or no further consideration or input on the part of the user. Weapons, such as bang sticks or spear guns, typically will not meet this criteria. Even a powerful land weapon such as a 45 caliber automatic pistol will not be satisfactory because it is not reasonably effective in driving the shark away and it does not meet any of the above requirements. Perhaps in the future electrical devices will be made so that they can produce predictable repelling stimuli to sharks, but at the present these devices have been unsuccessful.

Attempts to meet some of these criteria have resulted in the development of protective "shields." These devices basically comprise a life buoy from which a screen descends into the water to protect a floundering person in the open sea. For example, U.S. Pat. No. 3,222,701 issued to A. Fest on Dec. 14, 1965 discloses such a doughnut or toroidial shaped life buoy. When in operation a screen drops from the surface of the water from the life buoy to provide a shield around the seaman. Of course such a device requires time to employ, and can only be protective if the shark is not particularly aggressive. Since the shield is not water impervious, it does not abate the spreading of olfactory stimuli, and will be effective only if the shark is depending upon its visual sensory organs to find food. In a similar manner, U.S. Pat. No. 3,477,074 issued to B. S. Bezanis on Nov. 11, 1969 discloses a similar type device to that of Fest. Finally, one type of shark screen which does seem to have been successful was patented by C. S. Johnson on Feb. 5, 1969, and has a U.S. Pat. No. 3,428,978. The difference in the Johnson screen and the previously discussed screens is that the Johnson screen is made completely of a water impervious material. Water is added to the inside of the screen whilst there is no communication of water surrounding the bather to the outside sea water. Thus, not only can the shark not see the individual in the shark screen preserver, but there are no smell, taste or other olfactory cues to reveal the presence of the individual to the shark. Unfortunately, of course, in all of these screens, time is required to employ the device, and the individual's own movement is substantially curtailed such that the necessary activities which might otherwise be used by the individual to attract help or attention are constrained.

Therefore, it is another object of this invention to provide a passive and inexpensive method of repelling or avoiding predatory animals which has an unlimited life span, and which does not inhibit the other activities of the individual using the device.

As is well known, many small animals have evolved certain characteristics which provide them camouflage in their natural surroundings. That is, these animals blend harmoniously with their surroundings such that they are often times unnoticed unless they move. In contrast to camouflaged animals, however, other animals have evolved effective defensive mechanisms or distinctly different color strategies which are exactly the opposite to that of camouflage. These animals are said to be "aposematic" and are readily identified by bright characteristic colors and other signals such that they seem to advertise their very presence. There is of course a reason such aposematic animals survive. This reason is typically that these types of animals have very dangerous or unpleasant attributes in that they are usually poisonous or very distasteful. These animals advertise this by means of characteristic structures and/or colors such that a potential predator, which is usually much larger, avoids attacking them. For a complete or synoptic discussion of aposematism the reader is refered to Chapter 3, page 65 of the publication *Defence in Animals* by Mr. M. Edmunds published by the Longman Group Limited in Essex England, 1974. If aposematism is to be advantageous, the predator either must sample some of the prey and find them unpleasant and thereby "learn" to avoid animals of similar appearance in the future, or the predator must have an innate avoidance response to the aposematic signals. Most animals learn by experience to avoid aposematically patterned animals. However, such learning tends to occur when the predatory animal is young, and is testing the palatability of a variety of potential prey.

Some typical aposematic animals which everyone recognizes include for example: the skunk (mammal), insects such as the Monarch butterfly, and reptiles such as the Coral snake. A lesser known animal in this part of the world which is well known in the Pacific Island area is the extremely poisonous sea snake *Pelamis platurus*. Certain caterpillars such as the Cinnabar caterpillar are also well known. In addition, there are some deadly poisonous sea snails and slugs which are also brightly colored and readily distinguished by their predators.

Therefore, it will be appreciated that aposematic animals are typically either very distasteful or venomous, and have bright colors or other signals which cause predators to recognise and to avoid attacking them. Many animals learn by experience to avoid attacking these aposematic animals. However, more and more evidence from studies of animal behavior indicate the widespread occurrence of innate avoidances by predators.

In addition to those aposematic animals which are truly distasteful, poisonous or otherwise dangerous to the predator, there are often other harmless creatures which over a period of time have evolved color patterns such that they take advantage of the aposematic protection of the dangerous creatures. This is known as mimicry. For example, the Viceroy butterfly is completely edible to most birds. However, the Viceroy butterfly has evolved its coloration such that it is substantially similar to that of the Monarch butterfly. Therefore, the bird that has learned to avoid the Monarch butterfly also carefully avoids the Viceroy since it is not able to distinguish between the two. In a similar manner, the completely harmless King snake has similar coloration patterns to that of the deadly poisonous Coral snake. Likewise, there are certain sea snails which are absolutely harmless but have evolved coloration which is almost indistinguishable from that of the deadly poisonous sea snails after which their coloration is modelled.

DISCLOSURE OF THE INVENTION

Other objects and advantages will in part be obvious, will in part appear hereinafter, and will be accomplished by the present invention which provides a method of passively repelling a predatory organism from a target organism by the use of aposematic patterns and colorations. The method of this invention comprises the steps of first determining a coloration pattern which typically has at least two colors and which elicits an avoidance response in a selected predator. Once this coloration pattern has been determined, it is applied to selected items adjacent to the target organism(s). As an example, assuming that the predatory animal is a shark and the target organism to be protected is man, a particular coloration pattern which elicits an avoidance response in sharks is that of the sea snake *Pelamis platurus*. These poisonous snakes have a bright yellow colored body with black irregular spots scattered over the body. This coloration pattern may, for example, be applied to life rafts, swimming suits, wet suits, diving tanks, foot flippers and other bathing and diving apparel.

BRIEF DESCRIPTION OF THE DRAWINGS

The above mentioned features of the present invention will be more clearly understood from the consideration of the following description in connection with the accompanying drawings in which.

BEST MODE FOR CARRYING OUT THE INVENTION

Figure 1:
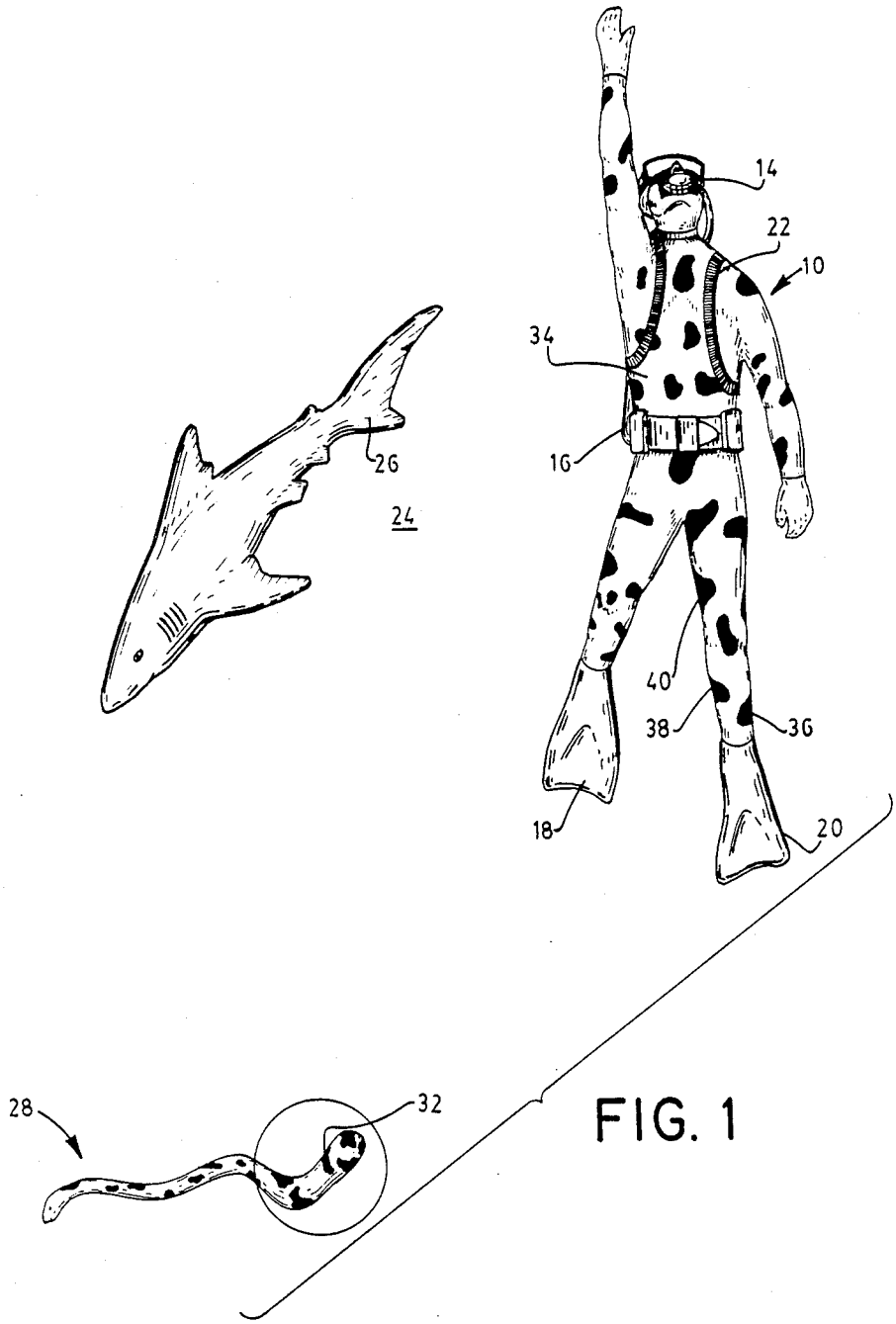
FIG. 1 is a pictorial and explanatory drawing showing a diver's wet suit designed to include and mimic the coloration patterns of the deadly poisonous sea snake *Pelamis platurus*.

Referring now to FIG. 1 there is shown a pictorial drawing illustrating the method of this invention as used by a diver in an aqua marine environment for the purpose of repelling or avoiding sharks. As shown, there is a SCUBA diver 10 wearing a wet suit 12 which incorporates the features of the method for repelling sharks of this invention. As would be normal with a SCUBA diver 10, the diver includes a mask 14, weights 16, foot flippers 18 and 20 along with breathing apparatus on his back not shown but represented by the strap 22. As shown, the diver is in a marine or sea environment 24 which might typically include various species of sharks 26 and poisonous sea snakes such as the extremely poisonous and dangerous sea snake *Pelamis platurus* 28. The sea snake 28 includes pattern coloration which is known as aposematic coloration and the particular sea snake *Pelamis platurus*' distinctive coloration includes a brightly yellow colored body 30 having thereon irregular but yet very distinct black spots 32. In a similar manner, and according to the present invention, the wet suit 12 of the diver 10 is manufactured such that it is of a bright yellow color background 34 which includes a multiplicity of irregular yet very distinct black spots such as at 36, 38, and 40.

In the past, it was believed or assumed by most scie tists that sharks generally had very poor eyesight a hunted or operated substantially by means of their sm or olfactory senses. However, as was discussed in article entitled "The Visual System of Sharks: Adap tions and Capability" by Mr. Samuel H. Greber co tained in the scientific journal *American Zoologist*, V ume 17, pages 453 through 469 and published in 1977, appears that far from having poor vision this very su cessful marine predator apparently has a high degree visual acuity. This article includes a complex stu concerning the spectral sensitivity of such sharks as t Lemon shark for determining sensitivity to flicker both dark and light settings. The article summarizes th although the study of the shark with respect to bas data on color vision is inconclusive, and the entire fie of spatial vision including visual acuity of sharks r mains unknown, the idea that sharks are nothing mo than "swimming noses" with crude sensory organs a poor visual systems is incorrect. Actually sharks have high degree of visual development. Behavioral e dence also indicates that at least some sharks have hi sensitivity and perception of colors and patterns. F example, according to the study entitled "Differenti Reactions of Atlantic and Pacific Predators to S Snakes" by Rubinoff and Kropach which appeared the journal *Nature* Volume 228 and dated Dec. 26, 19 at page 1288, the very dangerous Pacific sea snake *Pel mis platurus* is readily identified by carnivorous fish such as snappers and sharks. As was pointed out in t article, these sea snakes are frequent wanderers, do n hide, are brightly colored, and sluggish in movemer Therefore, this sea snake would appear to be partic larly vulnerable to a wide range of predators. As stat in the article however, according to tests with adu Pacific nurse sharks *Gingolymostoma cirratum*, whic are essentially scavengers and/or olfactory predato these sharks refuse to eat living or dead Pelamis s snakes. The tests also showed that even a pair of your nurse sharks which were probably not more than a fe weeks old (such that it was unlikely that either h experienced contact with the *Pelamis* sea snake) refus to take or eat these snakes. These juvenile sharks, whic were trained to accept food from the handlers by fo ceps, when offered pieces of frozen and fresh sea snal would invariably reject this offering. Thus, it appea that sharks, at least the nurse shark, are very sensitive the aposematic coloration of the sea snake Pelamis, a that avoidance of the aposematically patterned Pelam constitutes an innate response rather than a learn response. Although, it will be appreciated that if school of sharks have learned or acquired their avoi ance response to the Pelamis sea snake, this avoidan response would still be effective with respect to a div using devices or garments mimicing the coloration the sea snake. However, the diver is even better pr tected if the response is innate thereby reducing the ri of an uninitiated or unlearned shark deciding to samp the diver for taste.

Figure 2:
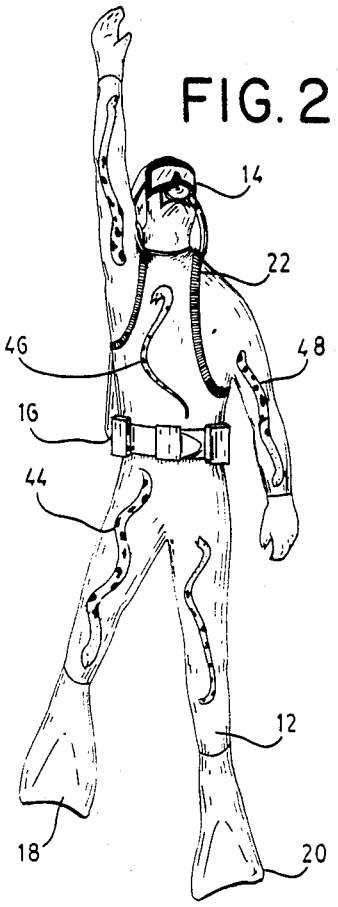
FIGS. 2 and 3 show alternate embodiments of a wet suit similar to that of FIG. 1.
Figure 3:
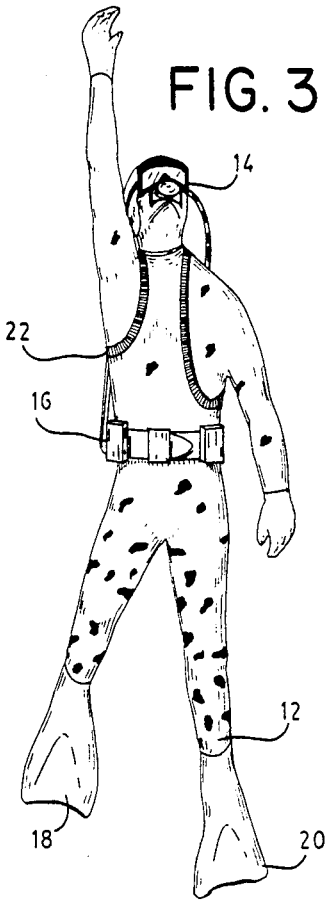
Figure 4:
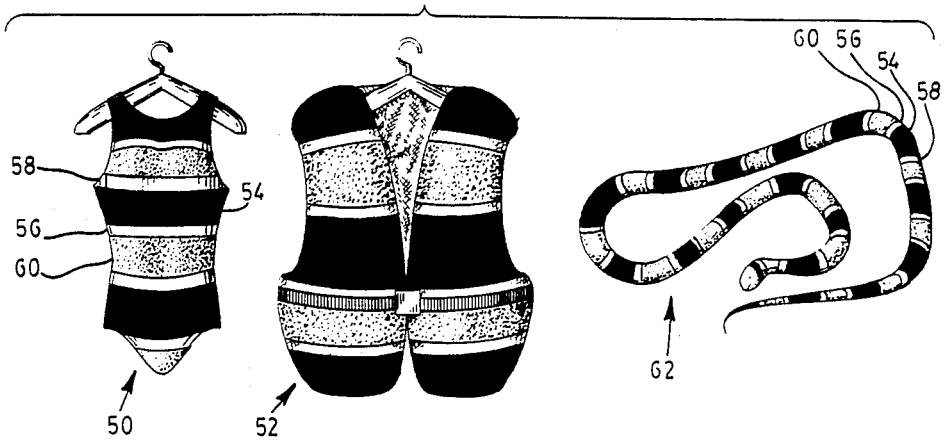
FIG. 4 shows an example of bathing apparel and a personal floating device designed to mimic the coloration pattern of the deadly poisonous Coral snake.

Thus referring again to FIG. 1, it will be appreciat that the pattern coloration of large black spots 36,3 and 40 on a yellow background 34 of the wet suit 12 c diver 10 simulates the natural aposematic coloration the very poisonous sea snake *Pelamis platurus* 28. At t present time, it is believed that the coloration pattern large distinct black splotches 36,38, and 40 on a yello background 34 such as shown in FIG. 1 will be mo effective in repelling shark 26 than smaller blotches o the background. However, as shown in FIGS. 2 and 3, different approaches can also be used which will provide a coloration pattern more similar in size to the actual snake of FIG. 1. As shown in FIG. 2, the diving suit is comprised basically of a background color 42 such as gray, blue, light green or white which substantially blends with the color of the water. Applied to this background color 42 are a multiplicity of facsimile such as 44, 46, and 48 representative of and substantially the same size as the actual sea snake *Pelamis platurus*. Alternately, as shown in FIG. 3, the background color is still bright yellow as discussed with respect to FIG. 1 except that now the irregular and distinct black spots are smaller and more similar in size to the spots which appear on the actual snake rather than the large spots shown in FIG. 1. Thus, according to this embodiment of the present invention, it will be appreciated that the method of avoiding or repelling by aposematic coloration includes determining and selecting coloration which is avoided by the predator shark animal 26 and then applying a representation of this pattern and coloration to items adjacent the target organism which in this case is the wet suit 12 of a diver or man 10. Referring now to FIG. 4, there is shown another example of aposematic coloration which mimics the bright and distinct coloration of the deadly poisonous coral snake. As shown, suitable bathing or diving equipment such as a swim suit 50 or a life vest 52 includes distinct banding patterns of a black color 54 surrounded by bands 56 and 58 of yellow followed by a red-orange color band 60. It is well known that the coral snake 62 includes similar banding of bright colors. That is, the black color 54 surrounded by two smaller bands of yellow 56 and 58 each of which is followed by the red-orange color 60.

Figure 5:
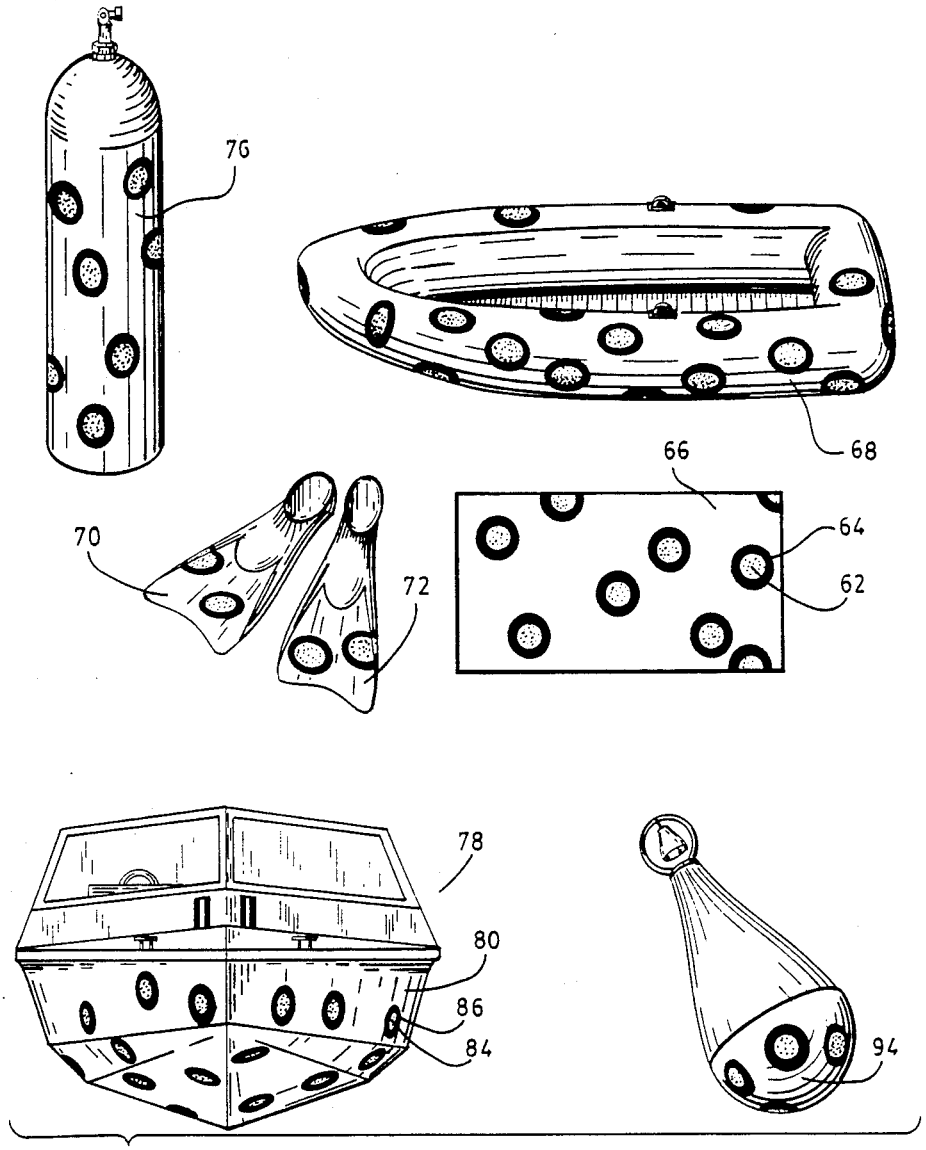
FIG. 5 illustrates aqua marine apparatus having a hypothetical aposematic pattern applied thereto.

In a similar manner, there is shown in FIG. 5 a hypothetical aposematic coloration which includes bright orange spots 62 surrounded with black rings 64 all of which are irregularly placed upon a white background item 66. As shown, the hypothetical pattern might well be included on such marine diving apparel and equipment such as a life raft 68, foot flippers 70 and 72 and diving tanks 76. These hypothetical patterns such as shown in FIG. 4 are believed to be effective as they all follow criteria which research has shown to almost always occur in aposematic organisms. These criteria typically include the requirement that there be at least two or more colors, that a change from one color to another is abrupt and that a manifest pattern is portrayed by these colors. That is, the colors do not blend or fade from one to the other. Further, it has been found that aposematic organisms always seem to include two or more of the colors selected from yellow, black and red. Although these three colors are predominant in the aposematic organisms, certain organisms do sometimes display other bright colors. For example, the color blue has been found in some aposematic organisms which are terrestrial, and may possibly be used by marine organisms. Further, typically, aposematic organisms use pattern banding such as the coral snake and/or variegated or intermixed patterns, such as used by the sea snake *Pelamis platurus*. However, in each situation the color change is abrupt. Thus, it should be noted that it is the contrasting colors that are critical and not the exact pattern itself. For example, the deadly poisonous coral snake has a different banding pattern or order than its mimic the King snake although the colors of both snakes are substantially the same. Although, the preferred embodiments of the present invention include aposematic coloration which mimics known dangerous or distasteful organisms, research indicates that it is the coloration that appears to be paramount and not the pattern. That is, it may be possible to derive a hypothetical coloration pattern which will elicit a stronger avoidance response in the predatory animal than a coloration pattern found in a natural aposematic organism.

Although the discussion heretofore has been with respect to aposematic coloration patterns used in diving gear, swimsuits and the like for the purpose of repelling sharks from an individual diver or group of divers, stranded seamen, pilots, or the like who may find themselves unavoidably caught in the water, it will be appreciated that in addition to the endangering of a person's life caught in the water without escape, such animals as sharks do a significant amount of damage which results in the loss of enormous sums of money in commercial areas with respect to fisheries. In particular, it is well known among tuna fishers that a shark can decimate a tuna catch to the costs of thousands of dollars. Therefore, it is believed that the aposematic coloration patterns which elicit the avoidance response of sharks with respect to individuals wearing such aposematically colored wetsuits and the like, might also be advantageously used on equipment associated with fisheries, fishing equipment, boats and the like. Such aposematic coloration may also be used for protective buoys and the like which are usually present or could be made present in bathing beaches etc.

Figure 6:
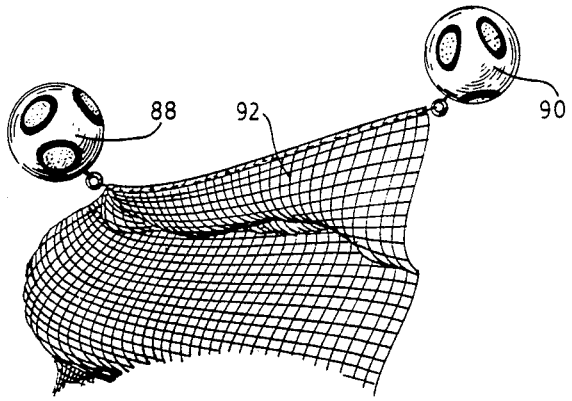
FIG. 6 illustrates how the aposematic coloration patterns may be used with respect to barriers at a bathing beach to deter sharks, or alternately may be used in conjunction with fishermens' apparatus to avoid decimation of a fisherman's catch by sharks attacking the catch.

For example referring now to FIG. 6, there is shown a typical fishing boat 78 which includes on its hull 80 a selected aposematic coloration pattern such as was shown in FIG. 5. That is, the background of the boat is white as indicated by reference number 82 on which there are applied orange dots 84 encircled by a black ring 86. In a similar manner, buoys or floats 88 and 90 suitable for supporting a fishing net 92 may also include such aposematic coloration. It is also believed that net 92 itself may advantageously include the aposematic colors, black, orange and white. As was mentioned herein above, and is shown at 94 a channel marker buoy or buoys located at a selected distance from the beach may also include the aposematic coloration for purposes of repelling sharks from the beach area. Alternately, of course, bright yellow with black splotches, like that of the coloration of the sea snake *Pelamis platurus*, could be used as well as other aposematic patterns.

Thus, although the present invention has been described with respect to specific methods for aposematic coloration applied to specific apparatus to elicit an avoidance response in selected organisms, it is not intended that such specific references be considered limitations upon the scope of this invention except insofar as is set forth in the following claims.

We claim:

1. A method of passively repelling a predatory organism from a target organism by the use of aposematic patterns and coloration comprising the steps of:

determining a coloration pattern having at least two distinct colors and which elicits an avoidance response in a selected species of predatory organisms; and applying the determined coloration pattern to selected items adjacent the target organism.

2. The method of claim 1 wherein said predatory organism and said target organism are located in an marine environment and said predatory organism is a shark.

3. The method of claim 2 wherein said target organism is a man.

4. The method of claims 2 or 3 wherein said selected coloration pattern is a mimic of the sea snake *Pelamis platurus* having a yellow background with black spots.

5. The method of claim 3 wherein said step of applying includes applying said coloration pattern to at least one of a wet suit, life preserver, bathing suit, foot flipper, and diving tanks.

6. The method of claims 1, 2, 3, or 5 wherein said coloration pattern includes at least two separate and contrasting colors and wherein a change in said pattern from one color to another is abrupt.

7. The method of claims 1, 2, 3, or 5 wherein sai colors are selected from yellow, black and red.

8. The method of claim 6 wherein said colors ar selected from yellow, black and red.

9. Water apparel for passively repelling predator sharks from a person comprising a garment having ap plied thereto aposematic patterns and coloration pat terns having at least two distinct colors and which elici an avoidance response in sharks.

10. The water apparel of claim 9 wherein said apose matic coloration pattern mimics the sea snake *Pelami platurus* and includes a yellow background with irregu lar black spots.

11. The water apparel of claim 9 wherein said color are selected from yellow, black and red.

* * * * *